US011100874B2

(12) United States Patent
Chen

(10) Patent No.: US 11,100,874 B2
(45) Date of Patent: Aug. 24, 2021

(54) PIXEL DRIVING METHOD AND DISPLAY DEVICE

(71) Applicants: HKC Corporation Limited, Guangdong (CN); Chongqing HKC Optoelectronics Technology Co., Ltd., Chongqing (CN)

(72) Inventor: Yu-Jen Chen, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 16/615,392

(22) PCT Filed: Aug. 31, 2017

(86) PCT No.: PCT/CN2017/099806
§ 371 (c)(1),
(2) Date: Nov. 20, 2019

(87) PCT Pub. No.: WO2018/214322
PCT Pub. Date: Nov. 29, 2018

(65) Prior Publication Data

US 2020/0184911 A1 Jun. 11, 2020

(30) Foreign Application Priority Data

May 26, 2017 (CN) ..... 201710385757.0

(51) Int. Cl.
*G09G 3/36* (2006.01)

(52) U.S. Cl.
CPC ..... *G09G 3/3607* (2013.01); *G09G 3/3688* (2013.01); *G09G 2310/027* (2013.01); *G09G 2320/0233* (2013.01)

(58) Field of Classification Search
CPC ..... G09G 3/3607; G09G 3/3688; G09G 2310/027; G09G 2320/0233
See application file for complete search history.

(56) References Cited

U.S. PATENT DOCUMENTS

2006/0103615 A1* 5/2006 Shih ..... G09G 3/3648 345/88
2006/0109224 A1 5/2006 Chang et al.
2017/0154587 A1* 6/2017 Chen ..... G09G 3/3607

FOREIGN PATENT DOCUMENTS

CN 101009083 A * 8/2007
CN 101009083 A 8/2007
(Continued)

*Primary Examiner* — Kenneth B Lee, Jr.
(74) *Attorney, Agent, or Firm* — Muncy, Geissler, Olds & Lowe, P.C.

(57) ABSTRACT

A pixel driving method includes: dividing blue subpixels on a display panel into multiple blue pixel sets; acquiring original driving data of each of the blue pixel sets an average thereof; acquiring unequal first and second voltage signals corresponding to the original driving data of each blue subpixel according to the average; dividing the blue subpixels of each blue pixel set into sets of blue pixel pairs comprising neighboring first and second blue subpixels; acquiring a first brightness signal according to the first voltage signal of the first blue subpixel and multiple first voltage signals of the neighboring blue subpixels and according to different weighting coefficients, and driving the first blue subpixel; and acquiring a second brightness signal according to the second voltage signal of the second blue subpixel and multiple second voltage signals of the neighboring blue subpixels and according to different weighting coefficients.

19 Claims, 8 Drawing Sheets

(56) References Cited

FOREIGN PATENT DOCUMENTS

| | | | |
|---|---|---|---|
| CN | 102246222 | A | 11/2011 |
| CN | 104299592 | A | 1/2015 |
| CN | 104835468 | A | 8/2015 |
| CN | 105632434 | A | 6/2016 |
| CN | 106531104 | A | 3/2017 |

* cited by examiner

PIXEL DRIVING METHOD AND DISPLAY DEVICE

CROSS REFERENCE TO RELATED APPLICATIONS

This Non-provisional application claims priority under 35 U.S.C. § 119(a) on Patent Application No(s). 201710385757.0 filed in People's Republic of China on May 26, 2017, the entire contents of which are hereby incorporated by reference.

BACKGROUND

Technical Field

This disclosure relates to a technical field of a display, and more particularly to a pixel driving method and a display device.

Related Art

Most of the existing large-size LCD display panels use negative type vertical alignment (VA) liquid crystal or in-plane switching (IPS) liquid crystal technology. Compared with the IPS liquid crystal technology, the VA-type liquid crystal technology has advantages of high production efficiency and low manufacturing cost, but has more obvious defects in the optical properties. More particularly, the large-size panels in the commercial applications need a larger viewing angle presentation, the VA-type liquid crystal driving often cannot satisfy the market application requirements in the viewing angle color shift.

By observing the gray-level brightness variations of the red sub-pixels R, green sub-pixels G and blue sub-pixels B in the front viewing angle and the side viewing angle, it is found that the brightness of the blue sub-pixels B in the side viewing angle increases as increasing of voltage. The trend of the brightness saturation of the blue sub-pixels B is obvious and fast than that of the red sub-pixels R and green sub-pixels G. Accordingly, when viewing the frame in a mixing color viewing angle, the image will have obvious color shift bias to blue.

SUMMARY

The various embodiments of this disclosure provide a pixel driving method and a display device capable of solving the viewing-angle color shift.

A pixel driving method comprises:

dividing blue sub-pixels on a display panel into a plurality of blue pixel sets;

acquiring original driving data of each of the blue pixel sets, and acquiring an average of all the blue sub-pixels of each of the blue pixel sets according to the original driving data;

acquiring one set of target gray-scale value pairs corresponding to the original driving data of each of the blue sub-pixels in the blue pixel set according to the average of the blue sub-pixels; wherein each of the sets of the target gray-scale value pairs comprise a first voltage signal and a second voltage signal unequal to each other; and the first voltage signal and the second voltage signal alternately drive a positive viewing-angle mixed brightness of the blue sub-pixel equivalent to a positive viewing-angle brightness of the blue sub-pixel driven by the original driving data;

dividing the blue sub-pixels of each of the blue pixel sets into a plurality of sets of blue pixel pairs, wherein each of the sets of the blue pixel pairs comprise a first blue sub-pixel and a second blue sub-pixel neighboring each other, and the first blue sub-pixel of one set of the blue pixel pairs in the neighboring blue pixel pairs neighbors the second blue sub-pixel of the other one set of the blue pixel pairs in the neighboring blue pixel pairs; and acquiring a first brightness signal according to the first voltage signal of the first blue sub-pixel and a plurality of first voltage signals of the blue sub-pixels neighboring the first blue sub-pixel and according to different weighting coefficients, and driving the first blue sub-pixel according to the first brightness signal; and acquiring a second brightness signal according to the second voltage signal of the second blue sub-pixel and a plurality of second voltage signals of the blue sub-pixels neighboring the second blue sub-pixel and according to different weighting coefficients, and driving the second blue sub-pixel according to the second brightness signal.

A display device comprises a display panel, wherein the pixel units on the display panel are divided into a plurality of pixel sets. Blue sub-pixels of each of the pixel sets are divided into a plurality of sets of blue pixel pairs; each of the sets of the blue pixel pairs comprise a first blue sub-pixel and a second blue sub-pixel neighboring each other, and the first blue sub-pixels of the neighboring blue pixel pairs are staggered; and a drive chip configured to acquire original driving data of each of blue pixel sets and acquire an average of all the blue sub-pixels of each of the blue pixel sets according to the original driving data, and configured to acquire one set of target gray-scale value pairs corresponding to the original driving data of each of the blue sub-pixels in the blue pixel set according to the average of the blue sub-pixels. The drive chip is further configured to acquire a first brightness signal according to a first voltage signal of the first blue sub-pixel and a plurality of first voltage signals of the blue sub-pixels neighboring the first blue sub-pixel and according to different weighting coefficients, and drive the first blue sub-pixel according to the first brightness signal. The drive chip is further configured to acquire a second brightness signal according to a second voltage signal of the second blue sub-pixel and a plurality of second voltage signals of the blue sub-pixels neighboring the second blue sub-pixel and according to different weighting coefficients, and drive the second blue sub-pixel according to the second brightness signal. Each of the sets of the target gray-scale value pairs comprise the first voltage signal and the second voltage signal unequal to each other. The first voltage signal and the second voltage signal alternately drive a positive viewing-angle mixed brightness of the blue sub-pixel equivalent to a positive viewing-angle brightness of the blue sub-pixel driven by the original driving data.

A pixel driving method comprises:

dividing blue sub-pixels on a display panel into a plurality of blue pixel sets;

acquiring original driving data of each of the blue pixel sets, and acquiring an average of all the blue sub-pixels of each of the blue pixel sets according to the original driving data;

acquiring a gray-scale-value look-up table according to the average of the blue sub-pixels, and looking up the gray-scale-value look-up table to find one set of the target gray-scale value pairs corresponding to the original driving data of each of the blue sub-pixels; wherein each of the sets of the target gray-scale value pairs comprise a first voltage signal and a second voltage signal unequal to each other;

wherein the first voltage signal and the second voltage signal alternately drive a positive viewing-angle mixed brightness of the blue sub-pixel equivalent to a positive viewing-angle brightness of the blue sub-pixel driven by the original driving data;

dividing the blue sub-pixels of each of the blue pixel sets into a plurality of sets of blue pixel pairs, wherein each of the sets of the blue pixel pairs comprise a first blue sub-pixel and a second blue sub-pixel neighboring each other, and the first blue sub-pixel of one set of the blue pixel pairs in the neighboring blue pixel pairs neighbors the second blue sub-pixel of the other one set of the blue pixel pairs in the neighboring blue pixel pairs; and acquiring a first brightness signal according to the first voltage signal of the first blue sub-pixel and a plurality of first voltage signals of the blue sub-pixels neighboring the first blue sub-pixel and according to different weighting coefficients, and driving the first blue sub-pixel according to the first brightness signal; and acquiring a second brightness signal according to the second voltage signal of the second blue sub-pixel and a plurality of second voltage signals of the blue sub-pixels neighboring the second blue sub-pixel and according to different weighting coefficients, and driving the second blue sub-pixel according to the second brightness signal.

In the pixel driving method and the display device, a plurality of blue sub-pixels in the display region are alternately driven according to unequal first brightness signal and second brightness signal, the image sub-pixel signal at the original position is replaced with high and low brightness interval signals, and the low brightness signal can function to improve the viewing-angle color shift. The pixels are no longer designed into the primary pixel and the secondary pixel, thereby significantly enhancing the penetration rate of the display panel and decreasing the backlight cost. For the high-resolution display panel development, the pixels are not configured to a primary pixel and a secondary pixel, so that the possibilities of the penetration rate and the improved resolution become more significant.

BRIEF DESCRIPTION OF THE DRAWINGS

The embodiments will become more fully understood from the detailed description and accompanying drawings, which are given for illustration only, and thus are not limitative of the present invention, and wherein.

DETAILED DESCRIPTION OF THE INVENTION

The embodiments of the invention will be apparent from the following detailed description, which proceeds with reference to the accompanying drawings, wherein the same references relate to the same elements.

Figure 1:
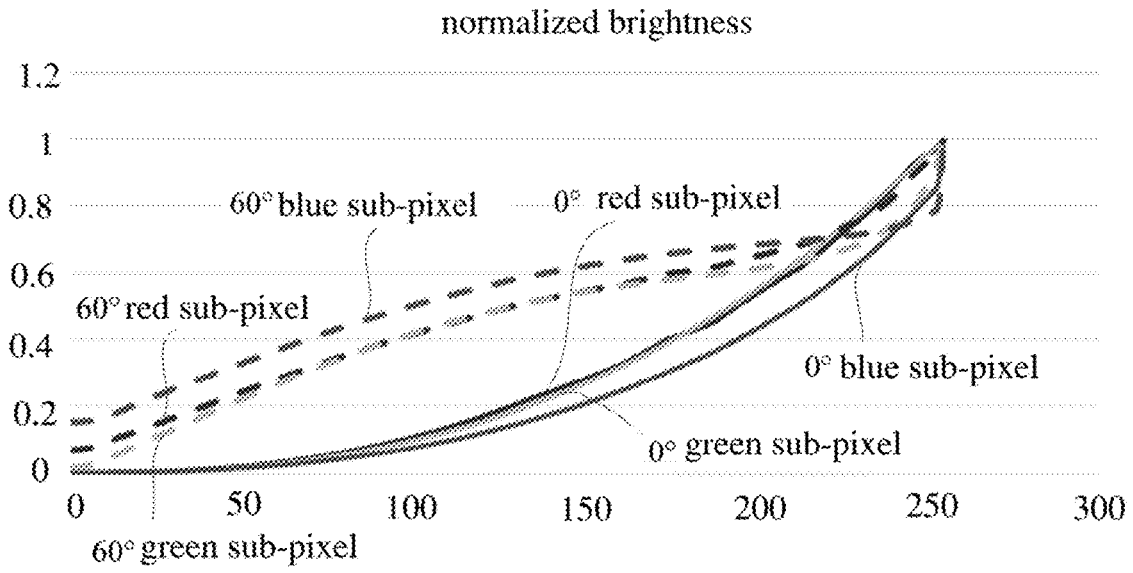
FIG. 1 is a graph showing a voltage increase of an exemplary sub-pixel changing with the brightness change at the angles of 0 and 60 degrees.

As shown in FIG. 1, gray scale brightness ratio changes of a red sub-pixel R, a green sub-pixel G and a blue sub-pixel B are observed at the front viewing angle and the side viewing angle in the VA type liquid crystal technology, wherein the vertical axis denotes the brightness, the horizontal axis denotes the voltage, and it is found that the brightness of the blue sub-pixel B increases with the voltage at the side viewing angle, and the brightness saturation trend is more significant and fast than those of the red sub-pixel R and the green sub-pixel G, so that the picture quality observed at the mixed color viewing angle presents the obvious defect of blue color shifting.

Figure 2:
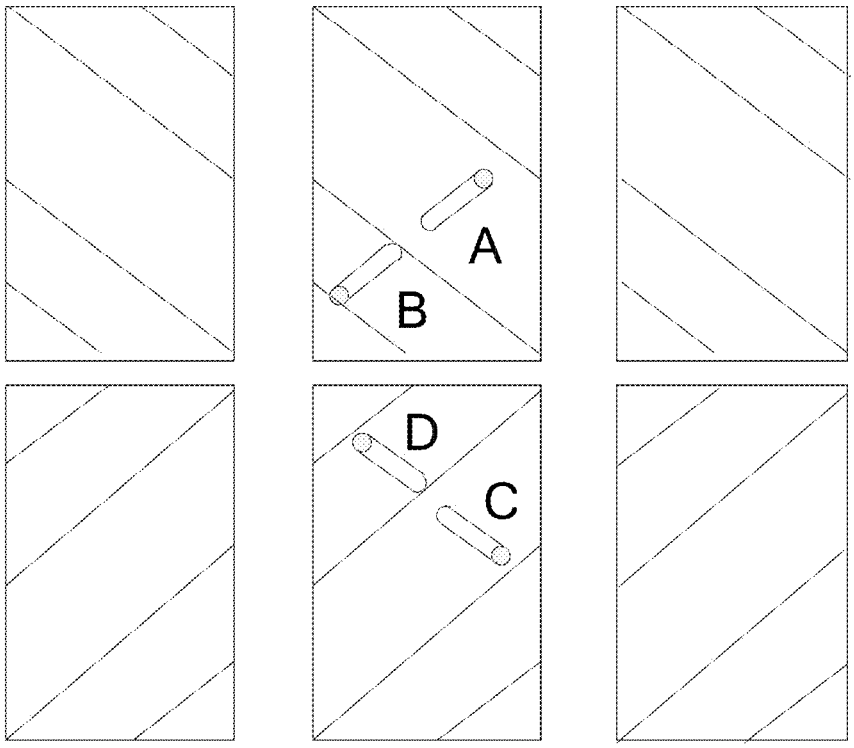
FIG. 2 is a schematic view showing exemplary primary pixel and secondary pixel.
Figure 3:
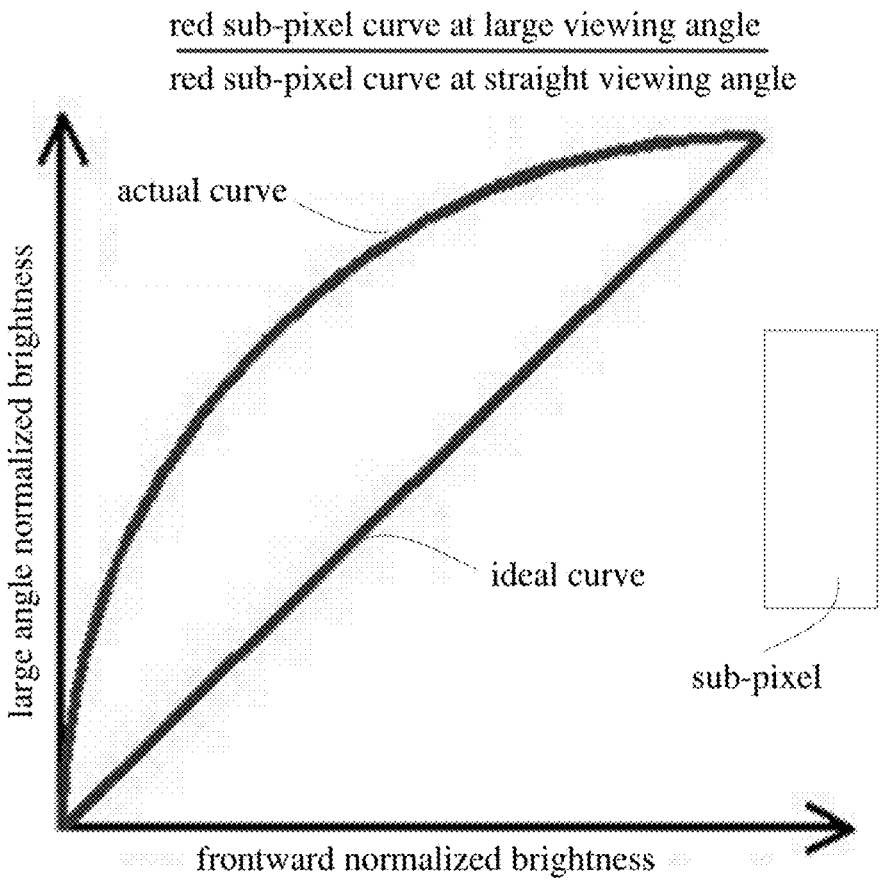
FIG. 3 is a graph showing corresponding front view and large angle of an exemplary pixel.
Figure 4:
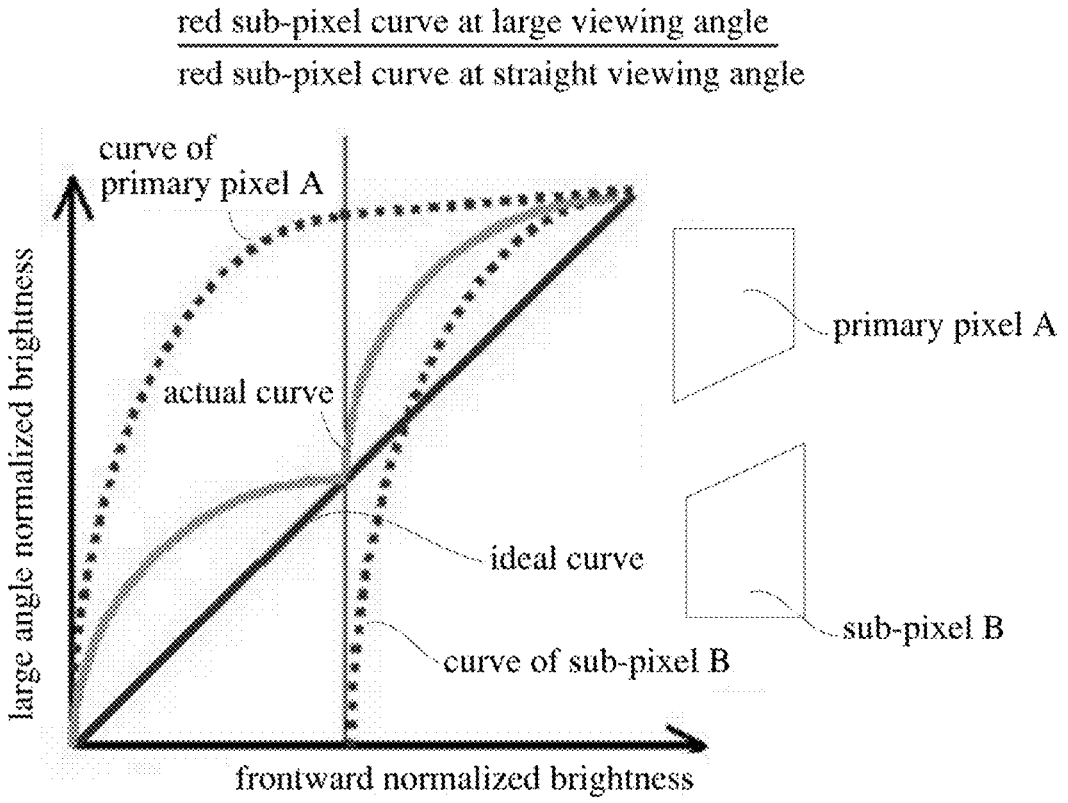
FIG. 4 is a graph showing corresponding front view and large angle of the exemplary primary pixel and secondary pixel.
Figure 5:
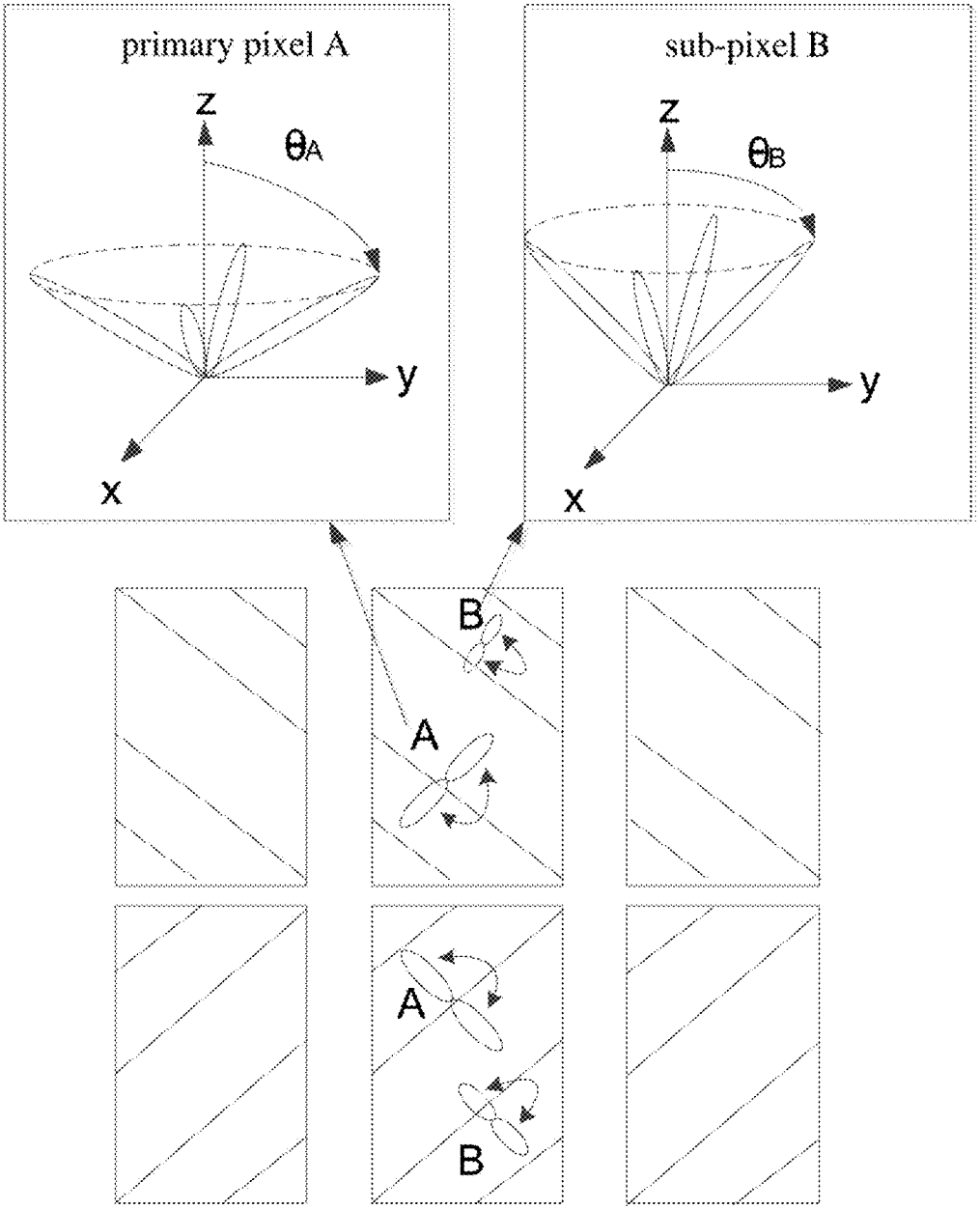
FIG. 5 is a schematic view showing motions of exemplary liquid crystal molecules.

As shown in FIG. 2, in order to solve the viewing-angle color shift in the VA type liquid crystal technology, each of the R, G and B sub-pixels is divided into a primary pixel and a secondary pixel. In FIG. 2, the blue sub-pixel B, the green sub-pixel G and the red sub-pixel R are disposed in order. Taking the green sub-pixel G as an example, the green sub-pixel G is divided into a primary pixel A and a secondary pixel B. Then, different driving voltages are applied to the primary pixel and the secondary pixel in the space. FIG. 3 shows the graph when the sub-pixel is not divided into the primary pixel and the secondary pixel, and FIG. 4 shows the graph when the sub-pixel is divided into the primary pixel and the secondary pixel. It is obtained that dividing the sub-pixel into the primary pixel and the secondary pixel can effectively solve the defect of the viewing-angle color shift. FIG. 5 is a schematic view showing motions of the pixel molecules of the RGB sub-pixel liquid crystal molecules in the low gray scale, the middle gray scale and the high gray scale, wherein the motions of the primary pixel A and the secondary pixel B of the liquid crystal molecules of the green sub-pixel G in the middle gray scale are shown in FIG. 5. However, such the pixel design needs to a metal layout or a TFT element to be designed to drive the secondary pixel, thereby sacrificing the light-permeable opening region, affecting the permeability of the panel, and directly increasing the backlight cost.

Figure 6:
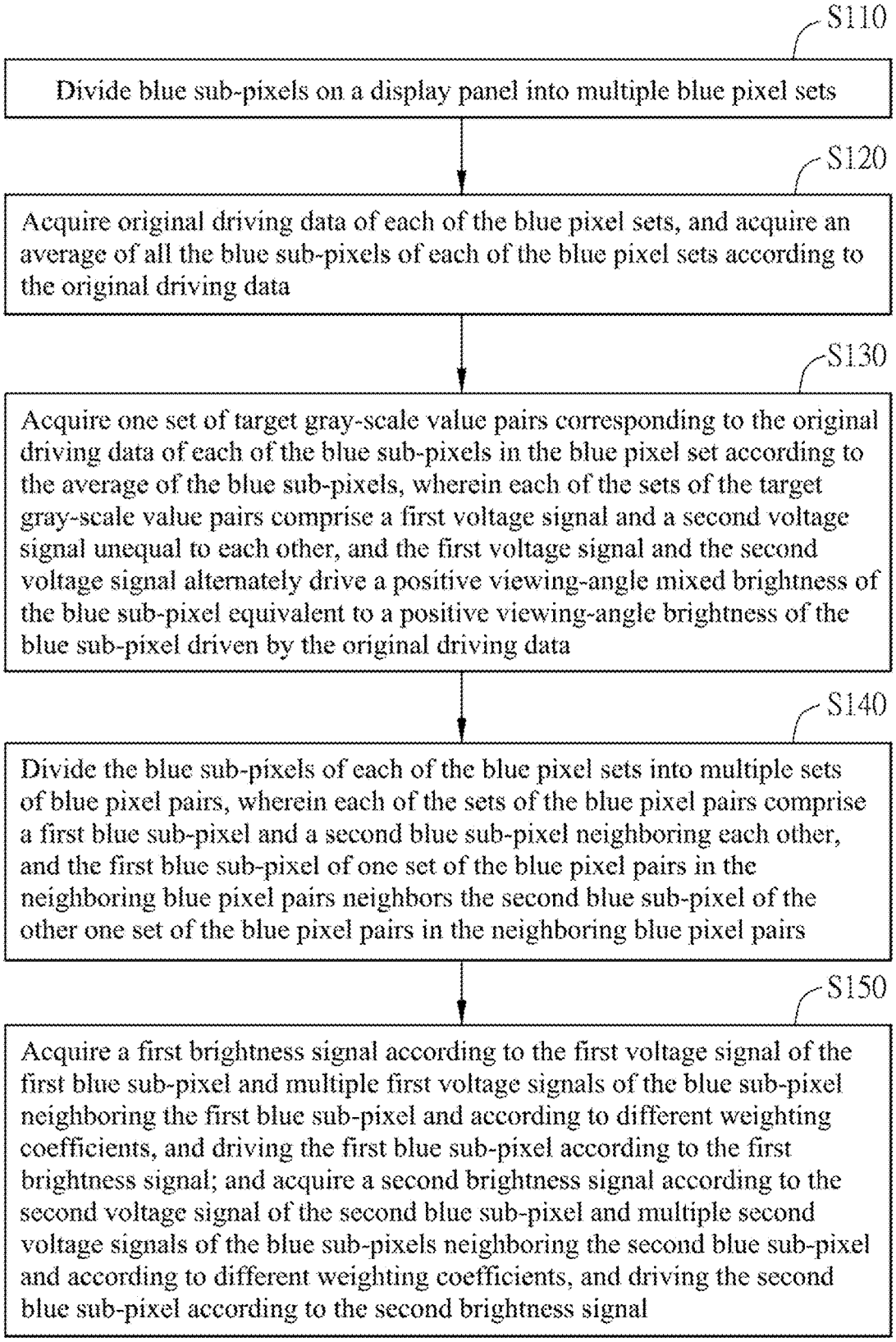
FIG. 6 is a flow chart showing a pixel driving method in an embodiment.

An embodiment provides a pixel driving method, as shown in FIG. 6. The pixel driving method can improve the color shift (or color difference) drawback caused by the large viewing angle of the liquid crystal refractivity mismatch. More particularly, the color shift defect caused by the too-early saturation of the blue sub-pixel at the large viewing angle can be effectively improved. The display panel may be a twisted nematic (TN), an optically compensated birefringence (OCB), a vertical alignment (VA) type and a curved surface type liquid crystal display panel, but is not limited thereto.

Referring to FIG. 6, the pixel driving method drives blue sub-pixels of a display panel, and the method includes the following steps.

In a step S110, the blue sub-pixels on the display panel are divided into a plurality of blue pixel sets.

Figure 10:
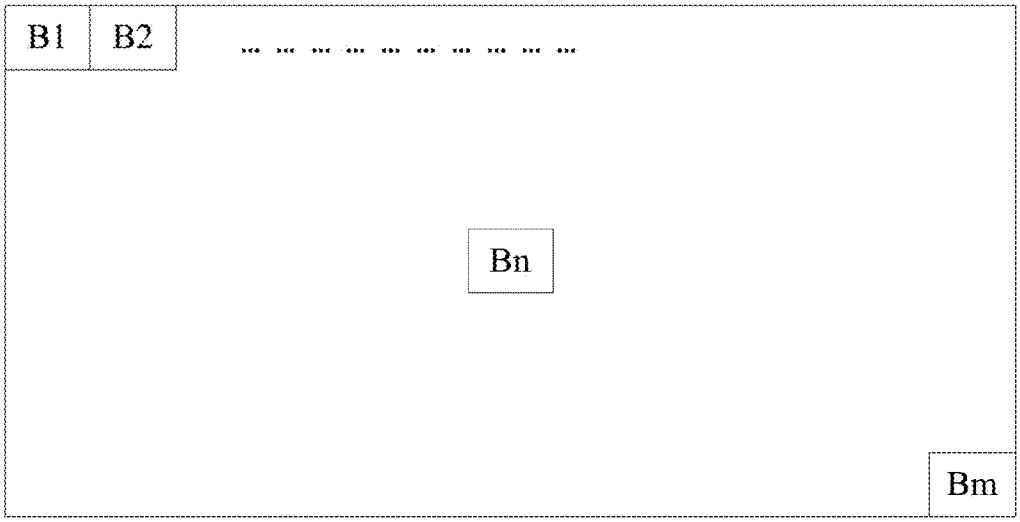
FIG. 10 is a schematic view showing a display panel in an embodiment.
Figure 11:
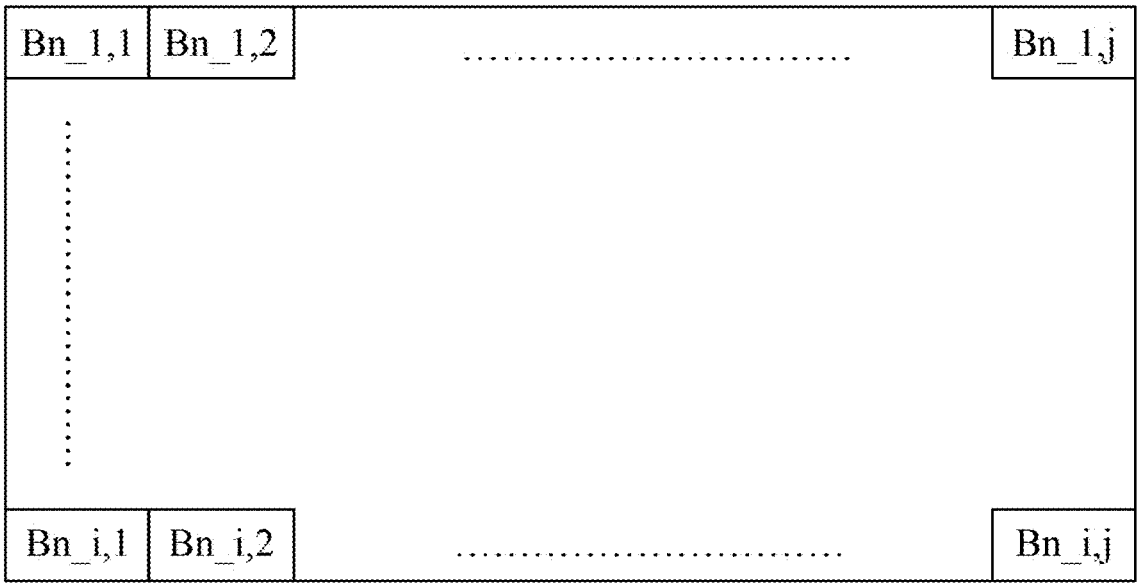
FIG. 11 is a schematic view showing a pixel set in an embodiment.

In this embodiment, the display panel includes at least blue sub-pixels. As shown in FIG. 10, the full size blue display region of the display panel in the space is divided into a plurality of pixel sets n=0, 1, 2, . . . , n, m, respectively marked as B1, B2, B3, . . . , Bn, . . . , Bm. As shown in FIG. 11, each of the pixel sets n includes a plurality of blue sub-pixels, wherein the blue sub-pixels in one pixel set n are arranged as Bn_1,1, Bn_1,2, . . . , Bn_i,j. The display panel is divided into a plurality of pixel sets. As more pixel sets are obtained, the number of divided parts of the blue signal gets more, and the displayed blue frame gets better. The pixel set includes a plurality of blue sub-pixels. As fewer blue sub-pixels are obtained, the blue resolution gets higher, but the calculation amount is increased. Thus, it is necessary to find a value (such as 10*10) corresponding to the reasonable calculation amount and the higher resolution. In other embodiments, the number of pixels included in each pixel set may be set according to the requirement.

In a step S120, original driving data of each of the blue pixel sets is acquired, and an average of all the blue sub-pixels of each of the blue pixel sets is acquired according to the original driving data.

In this embodiment, an average signal of original signals Bn_i,j of all the blue sub-pixels in the pixel set n is taken as:

$$Bn'=Average(Bn_1,1,\ Bn_1,2,\ \ldots,\ Bn_2,1,\ Bn_2,2\ \ldots,\ Bn_i,j),$$

where n denotes the serial number of the divided pixel set, and (i,j) denotes the order number of the blue sub-pixel in the whole pixel set.

In a step S130, one set of target gray-scale value pairs corresponding to the original driving data of each of the blue sub-pixels in the blue pixel set are acquired according to the average of the blue sub-pixels. Each of the sets of the target gray-scale value pairs include a first voltage signal and a second voltage signal unequal to each other. The first voltage signal and the second voltage signal alternately drive a positive viewing-angle mixed brightness of the blue sub-pixel equivalent to a positive viewing-angle brightness of the blue sub-pixel driven by the original driving data.

The original driving data of each of the blue sub-pixels corresponds to one set of target gray-scale value pairs. Each of the sets of the target gray-scale value pairs include the first voltage signal and the second voltage signal unequal to each other. The first voltage signal and the second voltage signal need to satisfy such that the first voltage signal and the second voltage signal alternately drive a positive viewing-angle mixed brightness of the blue sub-pixel equivalent to a positive viewing-angle brightness of the blue sub-pixel driven by the original driving data. Preferably, the large viewing angle brightness and the positive viewing-angle brightness of the original driving data corresponding to the first voltage signal and the second voltage signal are as close as possible. In an embodiment, the difference between the first voltage signal and the second voltage signal needs to be greater than a predetermined difference range, and thus to ensure that two gray scale values in the target gray-scale value pair have the larger gray scale difference. In this embodiment, the large viewing angle can be defined to be greater than 60°, or can be customized by the user.

In another embodiment, the step S130 comprises: acquiring a gray-scale-value look-up table according to the average of the blue sub-pixels, and looking up the gray-scale-value look-up table to find one set of the target gray-scale value pairs corresponding to the original driving data of each of the blue sub-pixels.

The gray scale value of each blue sub-pixel in the gray-scale-value look-up table corresponds to one set of target gray-scale value pairs. The target gray-scale value pairs can be acquired by looking up the gray-scale-value look-up table (LUT).

The drive signals of the different blue sub-pixels have different effects on the viewing-angle color shift. Thus, the averages of the different blue sub-pixels correspond to different gray scale values in the look-up table, so that the average corresponding to the different blue sub-pixels may obtain the target gray-scale value pair that is more suitable for the average of the blue sub-pixel. The target gray-scale value pair corresponds to the driving voltage (that is, the driving is made through a more appropriate driving voltage), thereby ensuring that the brightness of the adjusted blue sub-pixel changing with the gray scale change in the side view is closer to a variation curve in the front view. The corresponding relationship table of the average of each blue sub-pixel and the gray-scale-value look-up table can be pre-stored inside the storage part, so that the corresponding driving voltage can be determined according to the gray scale signal acquired from the look-up-table.

For example, when the average of the blue sub-pixel is smaller than the first predetermined value, such as 0.2 V, the gray-scale-value look-up table LUT1 is used. When the average of the blue sub-pixel is greater than the first predetermined value, such as 0.2 V, and is smaller than the second predetermined value, such as 0.4 V, the gray-scale-value look-up table LUT2 is used. The following table is listed.

| Input gray | LUT1 | | LUT2 | |
|---|---|---|---|---|
| scale value | Hn_i,j | Ln_i,j | Hn_i,j | Ln_i,j |
| 0 | 0 | 0 | 0 | 0 |
| 1 | 50 | 0 | 40 | 0 |
| 2 | 80 | 5 | 70 | 10 |
| 3 | 100 | 10 | 100 | 35 |
| 4 | 150 | 20 | 180 | 45 |
| 5 | 180 | 40 | 200 | 65 |
| . | . | . | . | . |
| . | . | . | . | . |
| . | . | . | . | . |
| 255 | 255 | 128 | 255 | 160 |

The above-listed table is merely a specific example. The range division of the averages of the blue sub-pixels and the corresponding relationship between the average of each blue sub-pixel and the gray-scale-value look-up table are not limited to the implemented aspect defined in the above-mentioned embodiment.

In another embodiment, the conversion relationship is acquired according to the average of the blue sub-pixels; and the original driving data of each blue sub-pixel based on the conversion relationship corresponds to one set of the target gray-scale value pairs. If the average of the blue sub-pixel is smaller than the first predetermined value, such as 0.2 V, then a first voltage signal is acquired by multiplying by a first coefficient smaller than 1 and a second voltage signal is acquired by multiplying by a second coefficient greater than one. Different first and second coefficients are acquired according to the average of the different blue sub-pixels, so that one different set of target gray-scale value pairs can be acquired.

In a step S140, the blue sub-pixels of each of the blue pixel sets are divided into a plurality of sets of blue pixel pairs. Each of the sets of the blue pixel pairs include a first blue sub-pixel and a second blue sub-pixel neighboring each other. The first blue sub-pixel of one set of the blue pixel pairs in the neighboring blue pixel pairs neighbors the second blue sub-pixel of the other one set of the blue pixel pairs in the neighboring blue pixel pairs.

The blue sub-pixels in each of the pixel sets are divided into a plurality of sets of blue pixel pairs, and each of the sets of the blue pixel pairs include a first blue sub-pixel and a second blue sub-pixel neighboring each other, wherein the first blue sub-pixel and the second blue sub-pixel may neighbor each other transversally or longitudinally. The first blue sub-pixels of the neighboring blue pixel pairs are staggered. That is, the first blue sub-pixel of one set of the blue pixel pairs neighbors the second blue sub-pixels in other sets of the blue pixel pairs.

In a step S150, a first brightness signal is acquired according to the first voltage signal of the first blue sub-pixel and a plurality of first voltage signals of the blue sub-pixel neighboring the first blue sub-pixel and according to different weighting coefficients, and the first blue sub-pixel is driven according to first brightness signal. A second brightness signal is acquired according to the second voltage signal of the second blue sub-pixel and a plurality of second voltage signals of the blue sub-pixels neighboring the second blue sub-pixel and according to different weighting coefficients, and the second blue sub-pixel is driven according to second brightness signal.

For example, the first voltage signal is a low voltage signal, and the second voltage signal is a high voltage signal, the first blue sub-pixel acquires its own low voltage signal and the neighboring low voltage signal, and then acquires a new low voltage signal (i.e., the first brightness signal) according to different weighting coefficients, and the second blue sub-pixel similarly acquires a new high voltage signal (i.e., the first brightness signal). Then, the new low voltage signal and the new high voltage signal drive the first blue sub-pixel and the second blue sub-pixel. The image sub-pixel signal at the original position are replaced with high and low brightness interval signals, the low brightness signal can function to improve the viewing-angle color shift, and the high brightness signal keeps the display resolution. In another embodiment, the first voltage signal is a high voltage signal, and the second voltage signal is a low voltage signal.

In this embodiment, the spatial original full-size blue display region is divided into several pixel sets, the image sub-pixel signal at the original position are replaced with high and low brightness interval signals, and the lower brightness signal can improve the viewing-angle color shift. In the case of maintaining the high penetration rate design, the pixel design without the low color shift compensation is used. The human eye is less sensitive to the blue resolution. The high and low brightness interval signals are provided to the blue sub-pixel in the space, so that the brightness change of blue at the side viewing angle is controlled. This improves the color difference drawback, caused by the refractivity mismatch at the large viewing angle of the display panel, and is especially applied to the TN, OCB or VA type liquid crystal display panel. The pixels are no longer designed into the primary pixel and the secondary pixel, thereby significantly enhancing the penetration rate of the display panel and decreasing the backlight cost without increasing the process difficulty of the display panel and affecting the product yield. This is more significant to the enhancement of the penetration rate and the resolution of the high-resolution display panel.

Figure 7:
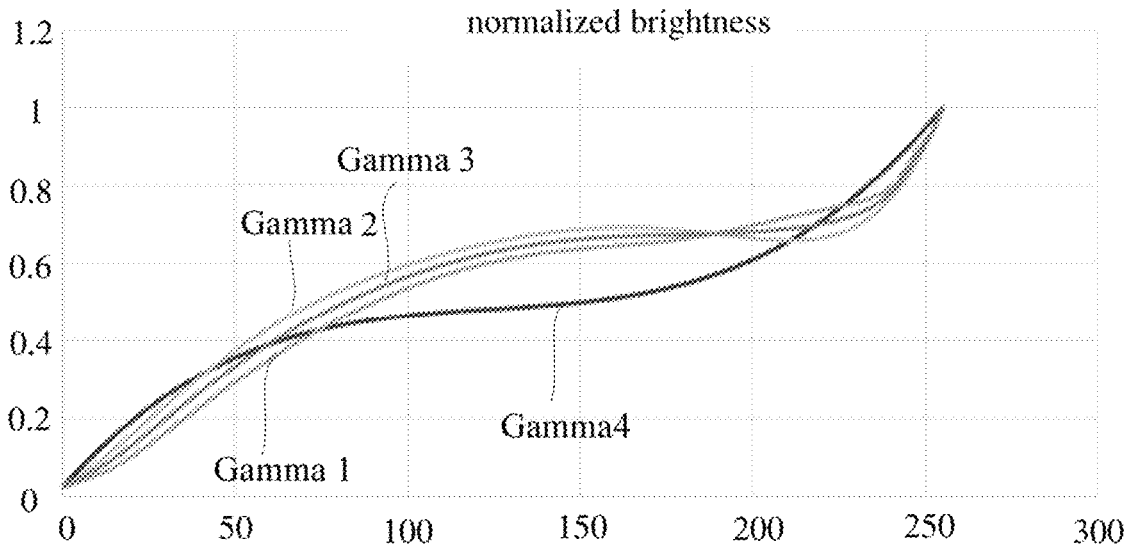
FIG. 7 is a graph showing a voltage increase of a blue sub-pixel changing with the brightness change in an embodiment.
Figure 8:
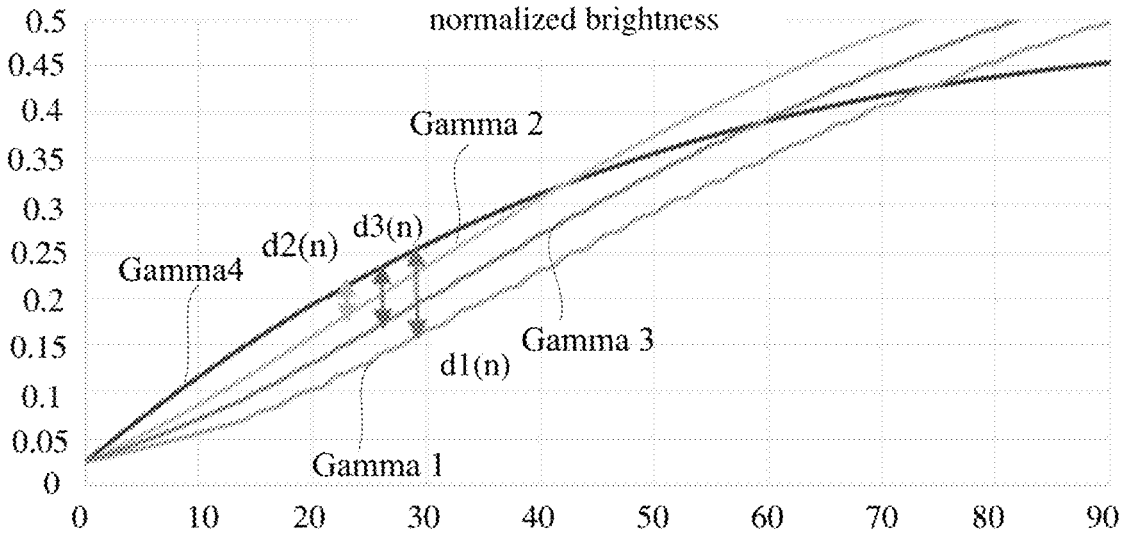
FIG. 8 is a graph showing a voltage increase of a blue sub-pixel changing with the brightness change in a low voltage segment in an embodiment.
Figure 9:
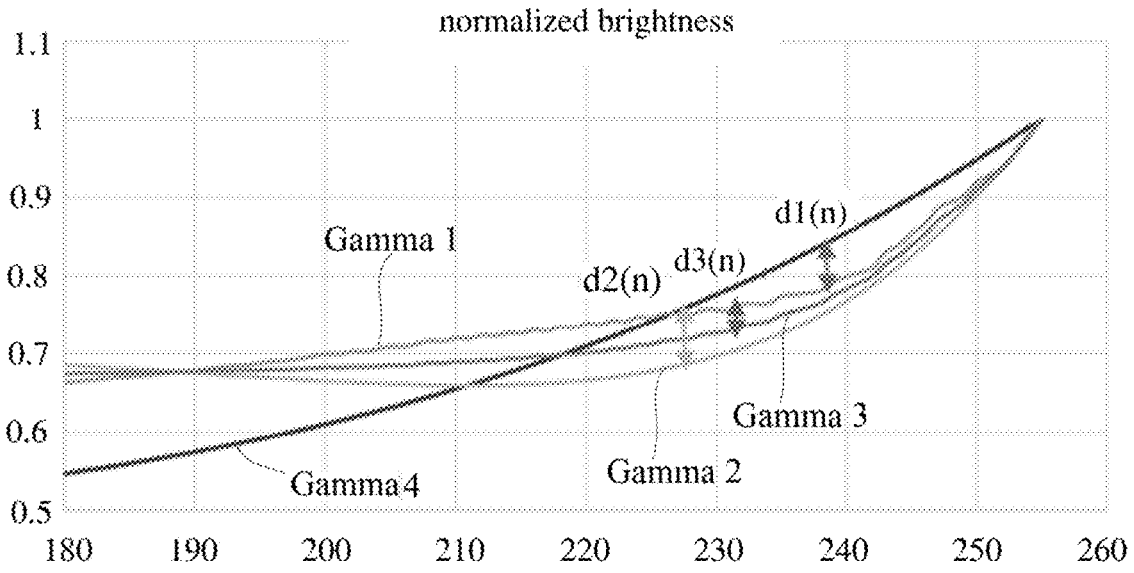
FIG. 9 is a graph showing a voltage increase of a blue sub-pixel changing with the brightness change in a high voltage segment in an embodiment.

The effect of improving the color shift of the driving method in this embodiment will be further described in the following with reference to FIGS. 7 to 9. The brightness saturation trend of the blue sub-pixel B with the voltage increase is controlled to be close to the red sub-pixel R and the green sub-pixel G, or the front-view brightness saturation trends of the red sub-pixel R, the green sub-pixel G and the blue sub-pixel B are controlled to decrease the serious defect of the viewing-angle color shift. As shown in FIG. 7, the gamma4 curve is a target curve of a brightness change curve of a blue sub-pixel changing with the voltage increase. The spatial high-low brightness signal interval display through the blue sub-pixel must satisfy that the front-view RGB brightness ratios do not change. The high voltage signal and the low voltage signal of the spatial high-low brightness signal interval display of the blue sub-pixel have several combinations causing different saturation conditions of the side-view brightness changing with the voltage change. In FIG. 7, the gamma curve of the first set combination of the high voltage signal and the low voltage signal of the blue sub-pixel is a gamma1 curve, the gamma curve of the second set is a gamma2 curve, and two combinations of the gamma1 and gamma2 curves show the different saturation conditions of the side-view brightness changing with the voltage change. As shown in FIG. 8, when considering the relationship between the low voltage and the brightness change, the difference between the actual brightness and the target brightness of the gamma1 curve of the first set is d1($n$), and is much larger than the difference value d2($n$) between the actual brightness and the target brightness of the gamma2 curve of the second set. However, as shown in FIG. 9, when considering the relationship between the high voltage and the brightness change, the difference between the actual brightness and the target brightness of the gamma1 curve of the first set is d1($n$) far smaller than the difference value d2($n$) of the gamma2 curve of the second set. When the combination of the high voltage and the low voltage of the spatial high-low brightness signal interval display of the blue sub-pixel is the gamma1 curve, it is suitable for the condition when the picture quality content presents the brightness signal with the higher blue. On the contrary, when the combination of the high voltage and the low voltage of the spatial high-low brightness signal interval display of the blue sub-pixel is the gamma2 curve, it is suitable for the condition when the picture quality content presents the brightness signal with the lower blue.

According to the local high voltage, the low voltage and the voltage curve in different combinations and designs, it is found that different degrees of differences are present between them and the target gamma curve, wherein the combination of the high voltage and the low voltage of the spatial high-low brightness signal interval display of one blue sub-pixel cannot concurrently satisfy the requirement that the high-low voltage brightness is close to the target brightness.

Figure 12:
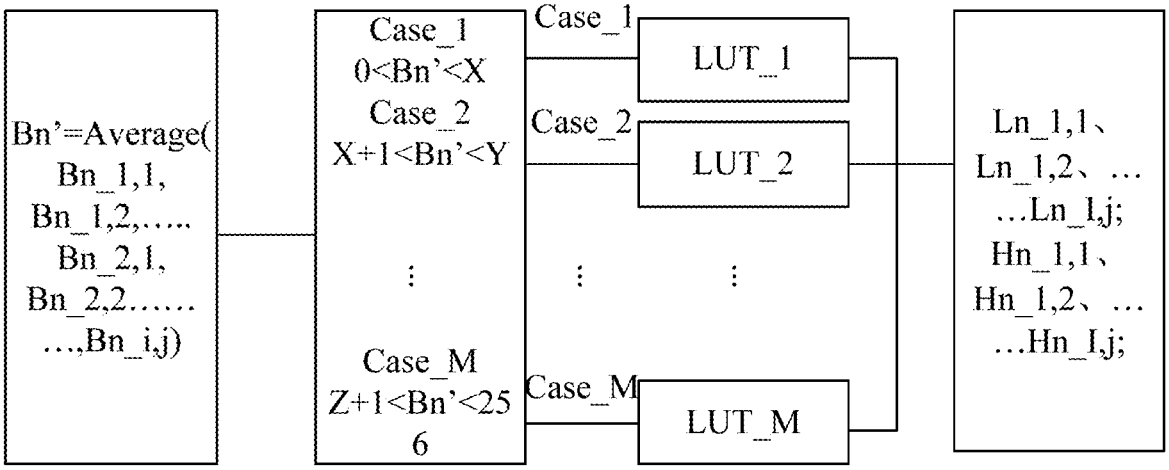
FIG. 12 is a flow chart showing a plurality of blue sub-pixels of the pixel set acquiring a combination of a first brightness signal and a second brightness signal in an embodiment.
Figure 13:
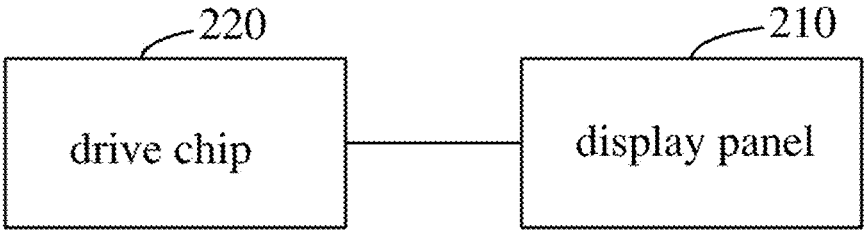
FIG. 13 is a block diagram showing a display device in an embodiment.

In this embodiment, the average signal Bn'=Average (Bn_1,1, Bn_1,2, . . . Bn_2,1, Bn_2,2 . . . , Bn_i,j) is taken according to the original signals Bn_i,j of all the blue sub-pixels in the block n. As shown in FIG. 12 and according to the average signal Bn', the look-up-table (LUT) acquires the combination of the corresponding first voltage signal and second voltage signal as Ln_ij and Hn_ij, that is, the combination of the low voltage signal and the high voltage signal. This has different averages for the different brightness of the blue picture quality signals. After the table is looked up, different combinations of the first voltage signal and the second voltage signal are acquired so that the gamma curve of the blue sub-pixel is closer to the target gamma curve. It is also possible to acquire the first voltage signals and the second voltage signals of all the blue sub-pixels in the corresponding display region (e.g., the first voltage signal is the original signal multiplied by a first coefficient smaller than one, and the second voltage signal is the original signal multiplied by a second coefficient greater than one) according to the predetermined function corresponding to the average. The first voltage signal is smaller than the second voltage signal, wherein the first voltage signal is smaller than the first voltage threshold value, and the second voltage signal is greater than the second voltage threshold value. The first voltage threshold value and the second voltage threshold value may be equal or unequal. If unequal values are present, then the first voltage threshold value may be smaller than the second voltage threshold value, and the first voltage signal and the second voltage signal may be better distinguished; and the first voltage threshold value may also be greater than the second voltage threshold value. The first voltage threshold value and the second voltage threshold value are different according to different averages, and change with the averages. When the blue brightness difference is larger (i.e., the average difference is larger), the first voltage signal and the second voltage signal can be better acquired. The first voltage threshold value may be an average multiplied by a coefficient smaller than or equal to one, and the second voltage threshold value may be an average multiplied by a coefficient greater than or equal to 1. The first voltage threshold value may be the original signal multiplied by a coefficient smaller than one, the second voltage threshold value may be the original signal multiplied by a coefficient greater than or equal to one, and the above-mentioned coefficients are determined by the averages.

As shown in FIG. 10, the blue sub-pixels in one pixel set n is the range of 10*10 blue sub-pixels, wherein the blue sub-pixels are Bn_1,1, Bn_1,2, . . . , Bn_10,10. In order to make the viewing angle gamma curve of the side-view blue sub-pixel closer to the front-view gamma curve, different blue sub-pixel signals may be theoretically given with the time loop switching of the high-low voltage timing to obtain the high-low voltage combination with the close front-view and side-view observation effects. For example, the loop switching is performed on the signals of Table 1 according to the predetermined timings and through the high voltage signals of Table 2 and the low voltage signals of Table 3.

TABLE 1

| | | | | | | | | | |
|---|---|---|---|---|---|---|---|---|---|
| Bn_1,1 | Bn_1,2 | Bn_1,3 | Bn_1,4 | Bn_1,5 | Bn_1,6 | Bn_1,7 | Bn_1,8 | Bn_1,9 | Bn_1,10 |
| Bn_2,1 | Bn_2,2 | Bn_2,3 | Bn_2,4 | Bn_2,5 | Bn_2,6 | Bn_2,7 | Bn_2,8 | Bn_2,9 | Bn_2,10 |
| Bn_3,1 | Bn_3,2 | Bn_3,3 | Bn_3,4 | Bn_3,5 | Bn_3,6 | Bn_3,7 | Bn_3,8 | Bn_3,9 | Bn_3,10 |
| Bn_4,1 | Bn_4,2 | Bn_4,3 | Bn_4,4 | Bn_4,5 | Bn_4,6 | Bn_4,7 | Bn_4,8 | Bn_4,9 | Bn_4,10 |
| Bn_5,1 | Bn_5,2 | Bn_5,3 | Bn_5,4 | Bn_5,5 | Bn_5,6 | Bn_5,7 | Bn_5,8 | Bn_5,9 | Bn_5,10 |
| Bn_6,1 | Bn_6,2 | Bn_6,3 | Bn_6,4 | Bn_6,5 | Bn_6,6 | Bn_6,7 | Bn_6,8 | Bn_6,9 | Bn_6,10 |
| Bn_7,1 | Bn_7,2 | Bn_7,3 | Bn_7,4 | Bn_7,5 | Bn_7,6 | Bn_7,7 | Bn_7,8 | Bn_7,9 | Bn_7,10 |
| Bn_8,1 | Bn_8,2 | Bn_8,3 | Bn_8,4 | Bn_8,5 | Bn_8,6 | Bn_8,7 | Bn_8,8 | Bn_8,9 | Bn_8,10 |
| Bn_9,1 | Bn_9,2 | Bn_9,3 | Bn_9,4 | Bn_9,5 | Bn_9,6 | Bn_9,7 | Bn_9,8 | Bn_9,9 | Bn_9,10 |
| Bn_10,1 | Bn_10,2 | Bn_10,3 | Bn_10,4 | Bn_10,5 | Bn_10,6 | Bn_10,7 | Bn_10,8 | Bn_10,9 | Bn_10,10 |

TABLE 2

| | | | | | | | | | |
|---|---|---|---|---|---|---|---|---|---|
| Ln_1,1 | Ln_1,2 | Ln_1,3 | Ln_1,4 | Ln_1,5 | Ln_1,6 | Ln_1,7 | Ln_1,8 | Ln_1,9 | Ln_1,10 |
| Ln_2,1 | Ln_2,2 | Ln_2,3 | Ln_2,4 | Ln_2,5 | Ln_2,6 | Ln_2,7 | Ln_2,8 | Ln_2,9 | Ln_2,10 |
| Ln_3,1 | Ln_3,2 | Ln_3,3 | Ln_3,4 | Ln_3,5 | Ln_3,6 | Ln_3,7 | Ln_3,8 | Ln_3,9 | Ln_3,10 |
| Ln_4,1 | Ln_4,2 | Ln_4,3 | Ln_4,4 | Ln_4,5 | Ln_4,6 | Ln_4,7 | Ln_4,8 | Ln_4,9 | Ln_4,10 |
| Ln_5,1 | Ln_5,2 | Ln_5,3 | Ln_5,4 | Ln_5,5 | Ln_5,6 | Ln_5,7 | Ln_5,8 | Ln_5,9 | Ln_5,10 |
| Ln_6,1 | Ln_6,2 | Ln_6,3 | Ln_6,4 | Ln_6,5 | Ln_6,6 | Ln_6,7 | Ln_6,8 | Ln_6,9 | Ln_6,10 |
| Ln_7,1 | Ln_7,2 | Ln_7,3 | Ln_7,4 | Ln_7,5 | Ln_7,6 | Ln_7,7 | Ln_7,8 | Ln_7,9 | Ln_7,10 |
| Ln_8,1 | Ln_8,2 | Ln_8,3 | Ln_8,4 | Ln_8,5 | Ln_8,6 | Ln_8,7 | Ln_8,8 | Ln_8,9 | Ln_8,10 |
| Ln_9,1 | Ln_9,2 | Ln_9,3 | Ln_9,4 | Ln_9,5 | Ln_9,6 | Ln_9,7 | Ln_9,8 | Ln_9,9 | Ln_9,10 |
| Ln_10,1 | Ln_10,2 | Ln_10,3 | Ln_10,4 | Ln_10,5 | Ln_10,6 | Ln_10,7 | Ln_10,8 | Ln_10,9 | Ln_10,10 |

TABLE 3

| | | | | | | | | | |
|---|---|---|---|---|---|---|---|---|---|
| Hn_1,1 | Hn_1,2 | Hn_1,3 | Hn_1,4 | Hn_1,5 | Hn_1,6 | Hn_1,7 | Hn_1,8 | Hn_1,9 | Hn_1,10 |
| Hn_2,1 | Hn_2,2 | Hn_2,3 | Hn_2,4 | Hn_2,5 | Hn_2,6 | Hn_2,7 | Hn_2,8 | Hn_2,9 | Hn_2,10 |
| Fin_3,1 | Hn_3,2 | Hn_3,3 | Hn_3,4 | Hn_3,5 | Hn_3,6 | Hn_3,7 | Hn_3,8 | Hn_3,9 | Hn_3,10 |
| Hn_4,1 | Hn_4,2 | Hn_4,3 | Hn_4,4 | Hn_4,5 | Hn_4,6 | Hn_4,7 | Hn_4,8 | Hn_4,9 | Hn_4,10 |
| Hn_5,1 | Hn_5,2 | Hn_5,3 | Hn_5,4 | Hn_5,5 | Hn_5,6 | Hn_5,7 | Hn_5,8 | Hn_5,9 | Hn_5,10 |
| Hn_6,1 | Hn_6,2 | Hn_6,3 | Hn_6,4 | Hn_6,5 | Hn_6,6 | Hn_6,7 | Hn_6,8 | Hn_6,9 | Hn_6,10 |
| Hn_7,1 | Hn_7,2 | Hn_7,3 | Hn_7,4 | Hn_7,5 | Hn_7,6 | Hn_7,7 | Hn_7,8 | Hn_7,9 | Hn_7,10 |
| Hn_8,1 | Hn_8,2 | Hn_8,3 | Hn_8,4 | Hn_8,5 | Hn_8,6 | Hn_8,7 | Hn_8,8 | Hn_8,9 | Hn_8,10 |
| Hn_9,1 | Hn_9,2 | Hn_9,3 | Hn_9,4 | Hn_9,5 | Hn_9,6 | Hn_9,7 | Hn_9,8 | Hn_9,9 | Hn_9,10 |
| Hn_10,1 | Hn_10,2 | Hn_10,3 | Hn_10,4 | Hn_10,5 | Hn_10,6 | Hn_10,7 | Hn_10,8 | Hn_10,9 | Hn_10,10 |

Presenting the original blue sub-pixel signals Bn_ij of Table 1 in order using the high-low voltage signal combinations of Tables 2 and 3 can improve viewing-angle color shift. However, under the restriction of the design of the charge limit ability of the display device, the naked eyes observe the serious brightness flicker phenomenon at the low frame scan frequency. Thus, the high-low brightness signal combinations Ln_ij and Hn_ij in the space are alternately arranged by sacrificing the resolution, as listed in Table 4, based on the characteristic that the blue color has the small influence on the resolution observation of the human eye. Under the precondition of maintaining the original image frame frequency display, it is unnecessary to use the difficult design of the high frame rate corresponding to the panel hardware design and to sacrifice the original image resolution too much, the high-low brightness interval signals are applied to a plurality of blue sub-pixels in the display region to replace the image sub-pixel signal applied at the original position, so that the color shift is improved.

Considering the individual blue sub-pixel, several blue sub-pixels in the space are taken as one unit. In the unit, the high-low brightness interval signals are applied to the blue sub-pixels to replace the image blue sub-pixel signal at the original position. As shown in Table 4, every five blue sub-pixels constitute one unit in the space. In the unit, Bn_3,4 is presented using the first brightness signal (i.e., the low brightness signal), wherein the low brightness signal can improve the viewing-angle color shift. In order to maintain the presentation of the pixel resolution, the first voltage signal for other blue sub-pixels (i.e., the pixels (Bn_2,4, Bn_3,3, Bn_3,5, Bn_4,4) neighboring Bn_3,4) in the unit is the low voltage signal allocated to the first voltage signal of Bn_3,4 in the unit.

In the unit, the low brightness signal calculation at the specific position is to count the low brightness signal compensations, which are theoretically needed to be provided to all the sub-pixels in the unit, and to perform the weighting coefficient adjustment on the influence of the true positions of the corresponding positions of the individual sub-pixels in the unit, so that the compensation effect of the low brightness sub-pixel signal can satisfy the effect of the average compensation signal required by the unit.

TABLE 4

| | | | | | | | | | |
|---|---|---|---|---|---|---|---|---|---|
| Hn_1,1 | Ln_1,2 | Hn_1,3 | Ln_1,4 | Hn_1,5 | Ln_1,6 | Hn_1,7 | Ln_1,8 | Hn_1,9 | Ln_1,10 |
| Ln_2,1 | Hn_2,2 | Ln_2,3 | Hn_2,4 | Ln_2,5 | Hn_2,6 | Ln_2,7 | Hn_2,8 | Ln_2,9 | Hn_2,10 |
| Hn_3,1 | Ln_3,2 | Hn_3,3 | Ln_3,4 | Hn_3,5 | Ln_3,6 | Hn_3,7 | Ln_3,8 | Hn_3,9 | Ln_3,10 |
| Ln_4,1 | Hn_4,2 | Ln_4,3 | Hn_4,4 | Ln_4,5 | Hn_4,6 | Ln_4,7 | Hn_4,8 | Ln_4,9 | Hn_4,10 |
| Hn_5,1 | Ln_5,2 | Hn_5,3 | Ln_5,4 | Hn_5,5 | Ln_5,6 | Hn_5,7 | Ln_5,8 | Hn_5,9 | Ln_5,10 |
| Ln_6,1 | Hn_6,2 | Ln_6,3 | Hn_6,4 | Ln_6,5 | Hn_6,6 | Ln_6,7 | Hn_6,8 | Ln_6,9 | Hn_6,10 |
| Hn_7,1 | Ln_7,2 | Hn_7,3 | Ln_7,4 | Hn_7,5 | Ln_7,6 | Hn_7,7 | Ln_7,8 | Hn_7,9 | Ln_7,10 |
| Ln_8,1 | Hn_8,2 | Ln_8,3 | Hn_8,4 | Ln_8,5 | Hn_8,6 | Ln_8,7 | Hn_8,8 | Ln_8,9 | Hn_8,10 |
| Hn_9,1 | Ln_9,2 | Hn_9,3 | Ln_9,4 | Hn_9,5 | Ln_9,6 | Hn_9,7 | Ln_9,8 | Hn_9,9 | Ln_9,10 |
| Ln_10,1 | Hn_10,2 | Ln_10,3 | Hn_10,4 | Ln_10,5 | Hn_10,6 | Ln_10,7 | Hn_10,8 | Ln_10,9 | Hn_10,10 |

As shown in Table 5, five blue sub-pixels are regarded as one unit, and the low brightness signal Ln_3,4 is given to the position corresponding to the specific blue sub-pixel Bn_3,4. In order to improve the resolution presented by the picture quality, the low brightness signal Ln_3,4 must further include the consideration of the low voltage signals Ln_2,4, Ln_3,3, Ln_3,5 and Ln_4,4 of neighboring blue sub-pixels Bn_2,4, Bn_3,3, Bn_3,5 and Bn_4,4 in addition to the presenting of its own Ln_3,4 low voltage signal, and the low voltage signals of the four blue sub-pixels can be allocated on neighboring blue sub-pixels that can present a low brightness signal. For example, the low voltage signal Ln_2,4 of the Bn_2,4 can allocate a signal to the blue sub-pixels corresponding to Ln_1,4, Ln_2,3, Ln_2,5 and Ln_3,4. Thus, the neighboring blue sub-pixels including the four blue sub-pixels Bn_2,4, Bn_3,3, Bn_3,5 and Bn_4,4 are disposed in a cruciform shape and are disposed around Bn_3,4. It is further possible to take 9 blue sub-pixels as one unit, and the neighboring blue sub-pixels include 8 blue sub-pixels Bn_2,3, Bn_2,4, Bn_2,5, Bn_3,3, Bn_3,5, Bn_4,3, Bn_4,4 and Bn_4,5, and are disposed around Bn_3,4.

A first brightness signal is acquired according to the first voltage signal of the first blue sub-pixel itself and a plurality of first voltage signals neighboring the blue sub-pixel and according to different weighting coefficients. The weighting coefficient value of the first voltage signal of the first blue sub-pixel itself is 0.5, and the weighting coefficient values of the first voltage signals of the neighboring blue sub-pixels are 0.125. The sum of the weighting coefficient values of the first voltage signals of the neighboring blue sub-pixels is smaller than or equal to 1. As shown in Table 5, five blue sub-pixels are regarded as one unit, and Bn_3,4 is the new low brightness signal Ln'_3,4 signal presented by the low brightness signal. The contributed weighting coefficients (presenting the low brightness signal Ln'_3,4 signal) of all of the low voltage signals Ln_ij of the blue sub-pixels in the unit are listed in Table 6. The Ln'_3,4 signal considers the low voltage signals Ln_2,4, Ln_3,3, Ln_3,5, Ln_4,4 and Ln_3,4 of five blue sub-pixels, wherein Ln_3,4 has the corresponding weighting coefficient value of 0.5, and the other four blue sub-pixels (Ln_2,4, Ln_3,3, Ln_3,5, Ln_4,4) have the corresponding weighting coefficient values of 0.125.

In another embodiment, a weighting coefficient value of the first voltage signal of the first blue sub-pixel is equal to a sum of weighting coefficient values of a plurality of first voltage signals of the blue sub-pixels neighboring the first blue sub-pixel. The edge points in Table 4 will obtain the better weighting coefficient values.

TABLE 5

| | | | | | | | | | |
|---|---|---|---|---|---|---|---|---|---|
| Hn'_1,1 | Ln'_1,2 | Hn'_1,3 | Ln'_1,4 | Hn'_1,5 | Ln'_1,6 | Hn'_1,7 | Ln'_1,8 | Hn'_1,9 | Ln'_1,10 |
| Ln'_2,1 | Hn'_2,2 | Ln'_2,3 | Hn'_2,4 | Ln'_2,5 | Hn'_2,6 | Ln'_2,7 | Hn'_2,8 | Ln'_2,9 | Hn'_2,10 |
| Hn'_3,1 | Ln'_3,2 | Hn'_3,3 | Ln'_3,4 | Hn'_3,5 | Ln'_3,6 | Hn'_3,7 | Ln'_3,8 | Hn'_3,9 | Ln'_3,10 |
| Ln'_4,1 | Hn'_4,2 | Ln'_4,3 | Hn'_4,4 | Ln'_4,5 | Hn'_4,6 | Ln'_4,7 | Hn'_4,8 | Ln'_4,9 | Hn'_4,10 |
| Hn'_5,1 | Ln'_5,2 | Hn'_5,3 | Ln'_5,4 | Hn'_5,5 | Ln'_5,6 | Hn'_5,7 | Ln'_5,8 | Hn'_5,9 | Ln'_5,10 |
| Ln'_6,1 | Hn'_6,2 | Ln'_6,3 | Hn'_6,4 | Ln'_6,5 | Hn'_6,6 | Ln'_6,7 | Hn'_6,8 | Ln'_6,9 | Hn'_6,10 |
| Hn'_7,1 | Ln'_7,2 | Hn'_7,3 | Ln'_7,4 | Hn'_7,5 | Ln'_7,6 | Hn'_7,7 | Ln'_7,8 | Hn'_7,9 | Ln'_7,10 |
| Ln'_8,1 | Hn'_8,2 | Ln'_8,3 | Hn'_8,4 | Ln'_8,5 | Hn'_8,6 | Ln'_8,7 | Hn'_8,8 | Ln'_8,9 | Hn'_8,10 |
| Hn'_9,1 | Ln'_9,2 | Hn'_9,3 | Ln'_9,4 | Hn'_9,5 | Ln'_9,6 | Hn'_9,7 | Ln'_9,8 | Hn'_9,9 | Ln'_9,10 |
| Ln_10,1 | Hn'_10,2 | Ln'_10,3 | Hn'_10,4 | Ln'_10,5 | Hn'_10,6 | Ln'_10,7 | Hn'_10,8 | Ln'_10,9 | Hn'_10,10 |

TABLE 6

| | | | | | | | | | |
|---|---|---|---|---|---|---|---|---|---|
| 0 | 0 | 0 | 0 | 0 | 0 | 0 | 0 | 0 | 0 |
| 0 | 0 | 0 | 0.125 | 0 | 0 | 0 | 0 | 0 | 0 |
| 0 | 0 | 0.125 | 0.5 | 0.125 | 0 | 0 | 0 | 0 | 0 |
| 0 | 0 | 0 | 0.125 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |

In one embodiment, the individual blue sub-pixels are considered, and several blue sub-pixels in the space are taken as one unit. In the unit, the high-low brightness signal interval display is given to the blue sub-pixel to replace the blue sub-pixel signal of the image at the original position. In this embodiment, every five blue sub-pixels in the space are taken as one unit. In the unit, Bn_2,4 is presented according to the high brightness signal. In order to maintain the presentation of the pixel resolution, the high voltage signal of other blue sub-pixels (i.e., the blue sub-pixels (Bn_1,4, Bn_2,3, Bn_2,5, Bn_3,4) neighboring Bn_2,4) in the unit is allocated to the high voltage signal of Bn_2,4 in the unit.

In the unit, the high brightness signal calculation at the specific position Bn_2,4 is to count the high brightness signal compensations, which are theoretically needed to be provided to all the sub-pixels in the unit, and to perform the weighting coefficient adjustment on the influence of the true positions of the corresponding positions of the individual sub-pixels in the unit, so that the compensation effect of the high brightness sub-pixel signal can satisfy the effect of the average compensation signal required by the unit.

As shown in Table 7, five blue sub-pixels are regarded as one unit, and the high brightness signal Hn'_2,4 is given to the position corresponding to the specific blue sub-pixel Bn_2,4. In order to improve the resolution presented by the picture quality, the high brightness signal Hn'_2,4 in addition to presenting its own Hn_2,4 high voltage signal must further include the consideration of the high voltage signals Hn_1,4, Hn_2,3, Hn_2,5 and Hn_3,4 of neighboring blue sub-pixels Bn_1,4, Bn_2,3, Bn_2,5 and Bn_3,4, and the high voltage signals of the four blue sub-pixels can be allocated on neighboring blue sub-pixels that can present a high brightness signal. For example, the high voltage signal Hn_3,4 of Bn_3,4 can allocate a signal to the blue sub-pixels corresponding to Hn_2,4, Hn_3,3, Hn_3,5 and Hn_4,4. Thus, the neighboring blue sub-pixels including the four blue sub-pixels Bn_1,4, Bn_2,3, Bn_2,5 and Bn_3,4 are disposed in a cruciform shape and are disposed around Bn_2,4. It is further possible to take 9 blue sub-pixels as one unit, and the neighboring blue sub-pixels include 8 blue sub-pixels Bn_1,3, Bn_1,4, Bn_1,5, Bn_2,3, Bn_2,5, Bn_3,3, Bn_3,4 and Bn_3,5, and are disposed around Bn_2,4.

TABLE 7

| | | | | | | | | | |
|---|---|---|---|---|---|---|---|---|---|
| Hn'_1,1 | Ln'_1,2 | Hn'_1,3 | Ln'_1,4 | Hn'_1,5 | Ln'_1,6 | Hn'_1,7 | Ln'_1,8 | Hn'_1,9 | Ln'_1,10 |
| Ln'_2,1 | Hn'_2,2 | Ln'_2,3 | Hn'_2,4 | Ln'_2,5 | Hn'_2,6 | Ln'_2,7 | Hn'_2,8 | Ln'_2,9 | Hn'_2,10 |
| Hn'_3,1 | Ln'_3,2 | Hn'_3,3 | Ln'_3,4 | Hn'_3,5 | Ln'_3,6 | Hn'_3,7 | Ln'_3,8 | Hn'_3,9 | Ln'_3,10 |
| Ln'_4,1 | Hn'_4,2 | Ln'_4,3 | Hn'_4,4 | Ln'_4,5 | Hn'_4,6 | Ln'_4,7 | Hn'_4,8 | Ln'_4,9 | Hn'_4,10 |
| Hn'_5,1 | Ln'_5,2 | Hn'_5,3 | Ln'_5,4 | Hn'_5,5 | Ln'_5,6 | Hn'_5,7 | Ln'_5,8 | Hn'_5,9 | Ln'_5,10 |
| Ln'_6,1 | Hn'_6,2 | Ln'_6,3 | Hn'_6,4 | Ln'_6,5 | Hn'_6,6 | Ln'_6,7 | Hn'_6,8 | Ln'_6,9 | Hn'_6,10 |
| Hn'_7,1 | Ln'_7,2 | Hn'_7,3 | Ln'_7,4 | Hn'_7,5 | Ln'_7,6 | Hn'_7,7 | Ln'_7,8 | Hn'_7,9 | Ln'_7,10 |
| Ln'_8,1 | Hn'_8,2 | Ln'_8,3 | Hn'_8,4 | Ln'_8,5 | Hn'_8,6 | Ln'_8,7 | Hn'_8,8 | Ln'_8,9 | Hn'_8,10 |
| Hn'_9,1 | Ln'_9,2 | Hn'_9,3 | Ln'_9,4 | Hn'_9,5 | Ln'_9,6 | Hn'_9,7 | Ln'_9,8 | Hn'_9,9 | Ln'_9,10 |
| Ln'_10,1 | Hn'_10,2 | Ln'_10,3 | Hn'_10,4 | Ln'_10,5 | Hn'_10,6 | Ln'_10,7 | Hn'_10,8 | Ln'_10,9 | Hn'_10,10 |

As shown in Table 7, five blue sub-pixels are regarded as a unit, and the new high brightness display signal Hn'_2,4 signal is presented using the Bn_2,4 position as the high brightness signal. The contributed weighting coefficients (presenting the new high brightness display signal Hn'_2,4 signal) of all of the high voltage signals Hn_ij of the blue sub-pixels in the block n are listed in Table 8. The Hn'_2,4 signal considers the high brightness signals Hn_1,4, Hn_2,3, Hn_2,5, Hn_3,4 and Hn_3,4 of five blue sub-pixels, wherein Hn_2,4 has the corresponding weighting coefficient value of 0.5, and the other four blue sub-pixels (Hn_1,4, Hn_2,3, Hn_2,5, Hn_3,4) have the corresponding weighting coefficient values of 0.125.

In another embodiment, a weighting coefficient value of the second voltage signal of the second blue sub-pixel is equal to a sum of weighting coefficient values of a plurality of second voltage signals of the blue sub-pixels neighboring the second blue sub-pixel. The edge points in Table 4 will get the better weighting coefficient values.

TABLE 8

| | | | | | | | | | |
|---|---|---|---|---|---|---|---|---|---|
| 0 | 0 | 0 | 0.125 | 0 | 0 | 0 | 0 | 0 | 0 |
| 0 | 0 | 0.125 | 0.5 | 0.125 | 0 | 0 | 0 | 0 | 0 |
| 0 | 0 | 0 | 0.125 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |
| 0 | 0 | 0 | 0 | 0 | 0 | 0 | 0 | 0 | 0 |

Thus, in this implementation method, the low gray scale brightness representative signal Ln'_3,4 given at the Bn_3,4 position is Ln'_3,4=0.5*Ln_3,4+0.125*(Ln_2,4+Ln_3,3+Ln_3,5+Ln_4,4).

Similarly, the brightness representative signal H'_24 at the high brightness position Bn_2,4 is Hn'_2,4=0.5*Hn_2,4+0.125*(Hn_1,4+Hn_2,3+Hn_2,5+Hn_3,4).

Analogically, each high-low voltage brightness position may be equivalent to the same result to achieve the viewing angle compensation and image resolution presentation at the same time.

This disclosure further provides a display device capable of performing the above-mentioned driving method. As shown in FIG. 14, the display device includes a display panel 210 and a drive chip 220.

The pixel units on the display panel 210 are divided into a plurality of pixel sets. The blue sub-pixels of each of the pixel sets are divided into a plurality of sets of blue pixel pairs. Each of the sets of the blue pixel pairs include a first blue sub-pixel and a second blue sub-pixel neighboring each other. The first blue sub-pixel of one set of the blue pixel pairs in the neighboring blue pixel pairs neighbors the second blue sub-pixel of the other one set of the blue pixel pairs in the neighboring blue pixel pairs.

The drive chip 220 is configured to acquire original driving data of each of blue pixel sets and acquire an average of all the blue sub-pixels of each of the blue pixel sets according to the original driving data, and configured to acquire one set of target gray-scale value pairs corresponding to the original driving data of each of the blue sub-pixels in the blue pixel set according to the average of the blue sub-pixels. The drive chip 220 is further configured to acquire a first brightness signal according to a first voltage signal of the first blue sub-pixel and a plurality of first voltage signals of the blue sub-pixels neighboring the first blue sub-pixel and according to different weighting coefficients, and drive the first blue sub-pixel according to the first brightness signal. The drive chip 220 is further configured to acquire a second brightness signal according to a second voltage signal of the second blue sub-pixel and a plurality of second voltage signals of the blue sub-pixels neighboring the second blue sub-pixel and according to different weighting coefficients, and drive the second blue sub-pixel according to the second brightness signal. Each of the sets of the target gray-scale value pairs comprise the first voltage signal and the second voltage signal unequal to each other. The first voltage signal and the second voltage signal alternately drive a positive viewing-angle mixed brightness of the blue sub-pixel equivalent to a positive viewing-angle brightness of the blue sub-pixel driven by the original driving data.

In another embodiment, the drive chip 220 is further configured to acquire a gray-scale-value look-up table according to the average of the blue sub-pixels, and look up the gray-scale-value look-up table to find one set of the target gray-scale value pairs corresponding to the original driving data of each of the blue sub-pixels.

In another embodiment, a weighting coefficient value of the first voltage signal of the first blue sub-pixel is equal to a sum of weighting coefficient values of a plurality of first voltage signals of the blue sub-pixels neighboring the first blue sub-pixel.

In another embodiment, a weighting coefficient value of the second voltage signal of the second blue sub-pixel is equal to a sum of weighting coefficient values of a plurality of second voltage signals of the blue sub-pixels neighboring the second blue sub-pixel.

In another embodiment, a plurality of blue sub-pixels neighboring the first blue sub-pixel include four blue sub-pixels and are disposed in a cruciform shape.

In another embodiment, a plurality of blue sub-pixels neighboring the second blue sub-pixel include four blue sub-pixels and are disposed in a cruciform shape.

In another embodiment, a plurality of blue sub-pixels neighboring the first blue sub-pixel include eight blue sub-pixels and are disposed in a star-shape.

In another embodiment, a plurality of blue sub-pixels neighboring the second blue sub-pixel include eight blue sub-pixels and are disposed in a star-shape.

The display device may also be a TN, OCB, VA type or curved surface display device, but is not limited thereto. The display device may be applied with the bottom lighting backlight, and the backlight source may be the white light source, RGB (three-color) light source, RGBW (four-color) light source or RGBY (four-color) light source, but is not limited thereto.

In this embodiment, the display device can be, for example, an OLED display panel, a QLED display panel, a curved display panel, or other display panels.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A pixel driving method, comprising:

dividing blue sub-pixels on a display panel into a plurality of blue pixel sets;

acquiring original driving data of each of the blue pixel sets, and acquiring an average of all the blue sub-pixels of each of the blue pixel sets according to the original driving data;

acquiring one set of target gray-scale value pairs corresponding to the original driving data of each of the blue sub-pixels in the blue pixel set according to the average of the blue sub-pixels;

wherein each of the sets of the target gray-scale value pairs comprise a first voltage signal and a second voltage signal unequal to each other;

dividing the blue sub-pixels of each of the blue pixel sets into a plurality of sets of blue pixel pairs, wherein each of the sets of the blue pixel pairs comprise a first blue sub-pixel and a second blue sub-pixel neighboring each other, and the first blue sub-pixel of one set of the blue pixel pairs in the neighboring blue pixel pairs neighbors the second blue sub-pixel of the other one set of the blue pixel pairs in the neighboring blue pixel pairs; and acquiring a first brightness signal according to the first voltage signal of the first blue sub-pixel and a plurality of first voltage signals of the blue sub-pixels neighboring the first blue sub-pixel and according to different weighting coefficients, and driving the first blue sub-pixel according to the first brightness signal; and acquiring a second brightness signal according to the second voltage signal of the second blue sub-pixel and a plurality of second voltage signals of the blue sub-pixels neighboring the second blue sub-pixel and according to different weighting coefficients, and driving the second blue sub-pixel according to the second brightness signal, wherein the first brightness signal and the second brightness signal are alternately arranged in both a row direction and a column direction such that the first voltage signal and the second voltage signal alternately drive the blue sub-pixel to obtain a front viewing-angle mixed brightness equivalent to a front-viewing-angle brightness when the original driving data drives the blue sub-pixel.

2. The pixel driving method according to claim 1, wherein acquiring the one set of target gray-scale value pairs corresponding to the original driving data of each of the blue sub-pixels in the blue pixel set according to the average of the blue sub-pixels comprises:

acquiring a gray-scale-value look-up table according to the average of the blue sub-pixels; and looking up the gray-scale-value look-up table to find one set of the target gray-scale value pairs corresponding to the original driving data of each of the blue sub-pixels.

3. The pixel driving method according to claim 1, wherein a weighting coefficient value of the first voltage signal of the first blue sub-pixel is equal to a sum of weighting coefficient values of a plurality of first voltage signals of the blue sub-pixels neighboring the first blue sub-pixel.

4. The pixel driving method according to claim 1, wherein a weighting coefficient value of the second voltage signal of the second blue sub-pixel is equal to a sum of weighting coefficient values of a plurality of second voltage signals of the blue sub-pixels neighboring the second blue sub-pixel.

5. The pixel driving method according to claim 1, wherein a plurality of blue sub-pixels neighboring the first blue sub-pixel comprise four blue sub-pixels.

6. The pixel driving method according to claim 1, wherein a plurality of blue sub-pixels neighboring the second blue sub-pixel comprise four blue sub-pixels.

7. The pixel driving method according to claim 1, wherein a plurality of blue sub-pixels neighboring the first blue sub-pixel comprise eight blue sub-pixels.

8. The pixel driving method according to claim 1, wherein a plurality of blue sub-pixels neighboring the second blue sub-pixel comprise eight blue sub-pixels.

9. The pixel driving method according to claim 1, wherein a difference between the first voltage signal and the second voltage signal is greater than a predetermined difference range.

10. A display device, comprising:

a display panel, wherein pixel units on the display panel are divided into a plurality of pixel sets; blue sub-pixels of each of the pixel sets are divided into a plurality of sets of blue pixel pairs, each of the sets of the blue pixel pairs comprise a first blue sub-pixel and a second blue sub-pixel neighboring each other, and the first blue sub-pixels of the neighboring blue pixel pairs are staggered; and a drive chip configured to acquire original driving data of each of blue pixel sets and acquire an average of all the blue sub-pixels of each of the blue pixel sets according to the original driving data, and configured to acquire one set of target gray-scale value pairs corresponding to the original driving data of each of the blue sub-pixels in the blue pixel set according to the average of the blue sub-pixels; wherein the drive chip is further configured to acquire a first brightness signal according to a first voltage signal of the first blue sub-pixel and a plurality of first voltage signals of the blue sub-pixels neighboring the first blue sub-pixel and according to different weighting coefficients, and drive the first blue sub-pixel according to the first brightness signal;

wherein the drive chip is further configured to acquire a second brightness signal according to a second voltage signal of the second blue sub-pixel and a plurality of second voltage signals of the blue sub-pixels neighboring the second blue sub-pixel and according to different weighting coefficients, and drive the second blue sub-pixel according to the second brightness signal;

wherein each of the sets of the target gray-scale value pairs comprise the first voltage signal and the second voltage signal unequal to each other; wherein the first brightness signal and the second brightness signal are alternately arranged in both a row direction and a column direction such that the first voltage signal and the second voltage signal alternately drive the blue sub-pixel to obtain a front viewing-angle mixed brightness equivalent to a front viewing-angle brightness when the original driving data drives the blue sub-pixel.

11. The display device according to claim 10, wherein the drive chip is further configured to acquire a gray-scale-value look-up table according to the average of the blue sub-pixels, and look up the gray-scale-value look-up table to find one set of the target gray-scale value pairs corresponding to the original driving data of each of the blue sub-pixels.

12. The display device according to claim 10, wherein a weighting coefficient value of the first voltage signal of the first blue sub-pixel is equal to a sum of weighting coefficient values of a plurality of first voltage signals of the blue sub-pixels neighboring the first blue sub-pixel.

13. The display device according to claim 10, wherein a weighting coefficient value of the second voltage signal of the second blue sub-pixel is equal to a sum of weighting coefficient values of a plurality of second voltage signals of the blue sub-pixels neighboring the second blue sub-pixel.

14. The display device according to claim 10, wherein a plurality of blue sub-pixels neighboring the first blue sub-pixel comprise four blue sub-pixels.

15. The display device according to claim 10, wherein a plurality of blue sub-pixels neighboring the second blue sub-pixel comprise four blue sub-pixels.

16. The display device according to claim 10, wherein a plurality of blue sub-pixels neighboring the first blue sub-pixel comprise eight blue sub-pixels.

17. The display device according to claim 10, wherein a plurality of blue sub-pixels neighboring the second blue sub-pixel comprise eight blue sub-pixels.

18. The display device according to claim 10, wherein a difference between the first voltage signal and the second voltage signal is greater than a predetermined difference range.

19. A pixel driving method, comprising:

dividing blue sub-pixels on a display panel into a plurality of blue pixel sets;

acquiring original driving data of each of the blue pixel sets, and acquiring an average of all the blue sub-pixels of each of the blue pixel sets according to the original driving data;

acquiring a gray-scale-value look-up table according to the average of the blue sub-pixels, and looking up the gray-scale-value look-up table to find one set of the target gray-scale value pairs corresponding to the original driving data of each of the blue sub-pixels; wherein each of the sets of the target gray-scale value pairs comprise a first voltage signal and a second voltage signal unequal to each other;

dividing the blue sub-pixels of each of the blue pixel sets into a plurality of sets of blue pixel pairs, wherein each of the sets of the blue pixel pairs comprise a first blue sub-pixel and a second blue sub-pixel neighboring each other, and the first blue sub-pixel of one set of the blue pixel pairs in the neighboring blue pixel pairs neighbors the second blue sub-pixel of the other one set of the blue pixel pairs in the neighboring blue pixel pairs; and acquiring a first brightness signal according to the first voltage signal of the first blue sub-pixel and a plurality of first voltage signals of the blue sub-pixels neighboring the first blue sub-pixel and according to different weighting coefficients, and driving the first blue sub-pixel according to the first brightness signal; and acquiring a second brightness signal according to the second voltage signal of the second blue sub-pixel and a plurality of second voltage signals of the blue sub-pixels neighboring the second blue sub-pixel and according to different weighting coefficients, and driving the second blue sub-pixel according to the second brightness signal, wherein the first brightness signal and the second brightness signal are alternately arranged in both a row direction and a column direction such that the first voltage signal and the second voltage signal alternately drive the blue-sub-pixel to obtain a front viewing-angle mixed brightness equivalent to a front-viewing-angle brightness when the original driving data drives the blue sub-pixel.

* * * * *